US008458931B2

(12) United States Patent
Knight

(10) Patent No.: US 8,458,931 B2
(45) Date of Patent: Jun. 11, 2013

(54) EXCAVATOR TOOTH RETENTION DEVICE

(75) Inventor: Garrett D. Knight, Kincardine (CA)

(73) Assignee: Raptor Mining Products Inc., Edmonton, Alberta (CA)

( * ) Notice: Subject to any disclaimer, the term of this patent is extended or adjusted under 35 U.S.C. 154(b) by 267 days.

(21) Appl. No.: 12/923,491

(22) Filed: Sep. 23, 2010

(65) Prior Publication Data

US 2011/0072693 A1 Mar. 31, 2011

Related U.S. Application Data

(60) Provisional application No. 61/272,487, filed on Sep. 29, 2009.

(51) Int. Cl.
*E02F 9/28* (2006.01)

(52) U.S. Cl.
USPC ..... 37/456

(58) Field of Classification Search
USPC ..... 37/446, 452–458; 172/719, 772, 172/772.5; 403/374.1, 374.3, 374.4, 373
See application file for complete search history.

(56) References Cited

U.S. PATENT DOCUMENTS

| | | | | | |
|---|---|---|---|---|---|
| 4,433,496 | A * | 2/1984 | Jones et al. | 37/456 |
| 5,410,826 | A * | 5/1995 | Immel et al. | 37/457 |
| 5,452,529 | A * | 9/1995 | Neuenfeldt et al. | 37/455 |
| 5,784,813 | A * | 7/1998 | Balassa et al. | 37/455 |
| 5,868,518 | A * | 2/1999 | Chesterfield et al. | 403/379.4 |
| 5,964,547 | A * | 10/1999 | Brinkley | 403/374.3 |
| 6,009,644 | A * | 1/2000 | Hedley | 37/456 |
| 6,301,810 | B1 * | 10/2001 | Fidler | 37/458 |
| 6,986,216 | B2 * | 1/2006 | Emrich et al. | 37/450 |
| 7,516,564 | B2 * | 4/2009 | Ruvang | 37/456 |

* cited by examiner

*Primary Examiner* — Robert Pezzuto

(57) ABSTRACT

A tooth retention device for attachment to an excavator bucket, which has a tooth mounting portion, a fork shaped body fitting over the edge of the bucket, a clamp passing through the body and the bucket, and a wedge holding the clamp in position, in which the wedge has a threaded rod and a threaded block on the rod. The rod is rotatable to move the block between locked and released positions.

9 Claims, 5 Drawing Sheets

EXCAVATOR TOOTH RETENTION DEVICE

FIELD OF THE INVENTION

The invention relates to excavator equipment with a bucket or shovel of the type having teeth, and in particular to a retaining device for retaining teeth on the shovel or bucket of such equipment, in which the retaining device can be fastened and released without the use of hammers. The subject of this application is based on U.S. Provisional Application No. 61/272,487 filed on 29 Sep. 2009 titled EXCAVATOR TOOTH RETENTION DEVICE, Inventor Garrett D. Knight.

BACKGROUND OF THE INVENTION

Excavators usually have a bucket or shovel, and teeth are attached to the leading edge of the bucket, to assist in penetrating the material. The teeth are subject to heavy wear. They are replaced at frequent service intervals.

Tooth retention devices are provided which attach to the leading edge of the bucket. These devices have mechanisms which secure the individual teeth. They permit the release and replacement of the teeth as required.

The tooth retention devices are also subject to heavy wear. They are releasably secured to the leading edge of the bucket. They must also be removed and replaced as required.

The invention is directed to such tooth retention devices, and to a system for attaching and releasing them without the use of hammers.

BRIEF SUMMARY OF THE INVENTION

The invention seeks to provide a tooth retention device for attachment to an excavator bucket, which has a tooth mounting portion, a forked shaped body fitting over the edge of the bucket, a clamp passing through the body and the bucket, and a wedge holding the clamp in position, in which the wedge has a threaded rod and a wedge block on the rod. The rod is rotatable to move the block between locked and released positions.

Preferably the wedge is generally tapered from a narrow end to a wider end and the clamp has a wedge engaging surface angled to receive the tapered wedge.

Preferably, the lip of the bucket is formed with an opening through which the clamp can be passed, and the lip of the bucket has a wedge engaging surface for receiving the wedge. Preferably the lip of the bucket is also formed with diverging pressure surfaces and the clamp is formed with diverging clamping surfaces, the respective surfaces being inter engageable when the wedge is inserted.

Preferably the clamp also has wedge receiving recesses, through which the wedge can be inserted between the clamp and the lip so that when the block on the wedge is tightened up, the lip and the clamp are forced apart, thereby forcing the clamp into engagement with the lip.

Preferably there is a resilient cap which can be applied to the top of the rod, and the rod has a head, receiving the cap, so as to protect the head of the threaded rod from damage.

Preferably, the threaded rod has an annular collar, and the wedge has a semi annular recess, with the collar fitting within the recess, while permitting the threaded rod to be rotated.

In a preferred embodiment of the Invention, the wedge has a wedge block with a wedge rack portion. The clamp has a clamp rack portion, the two rack portions being inter engagable securely. The wedge block has a threaded bore, and through the threaded bore, the threaded rod is connected so that the block can be tightened up.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
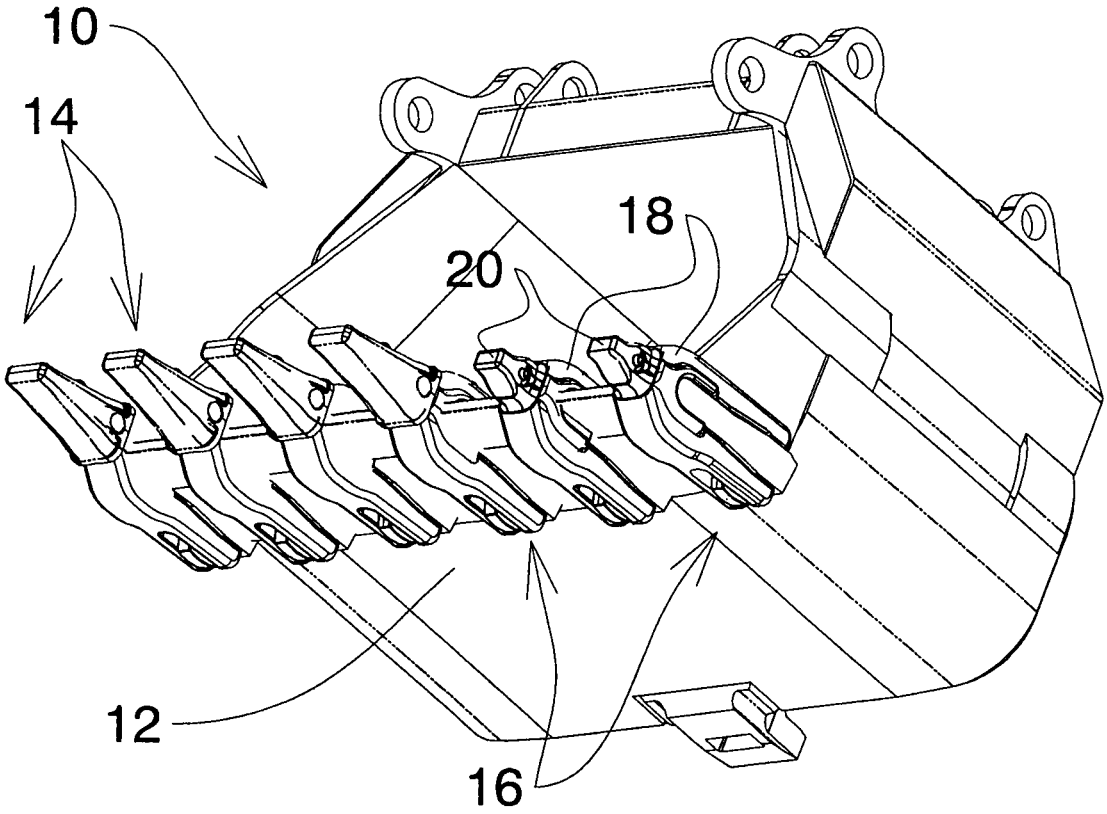
FIG. 1 is a general isometric view of an excavator bucket.

Referring to FIG. 1 it will be seen that the invention is illustrated there in relation to an excavator bucket (10). The bucket is mounted on any of a variety of pieces of excavator equipment (not shown) which require no description.

The bucket has a leading lower lip (12) provided with a plurality of tooth members (14).

Each tooth is retained on an individual tooth retention device (16).

The tooth retention devices are secured to the lip (12) at spaced intervals.

Each tooth can be attached to and removed from its tooth retention device by means known in the art and requiring no description.

The tooth retention device (16) is also releasable and replaceable, as and when required. In the past the attachment system used for this purpose, involved the use of simple metal wedge pieces, which were hammered into a space in the tooth retention device. Removal involved hammering the wedges pieces, in the opposite direction, to release them.

This was tiresome, and difficult.

The invention is directed to a tooth retention device having an improved attachment for securing the tooth retention devices to the bucket, and enabling its release for replacement in a quicker more efficient manner.

Figure 2:
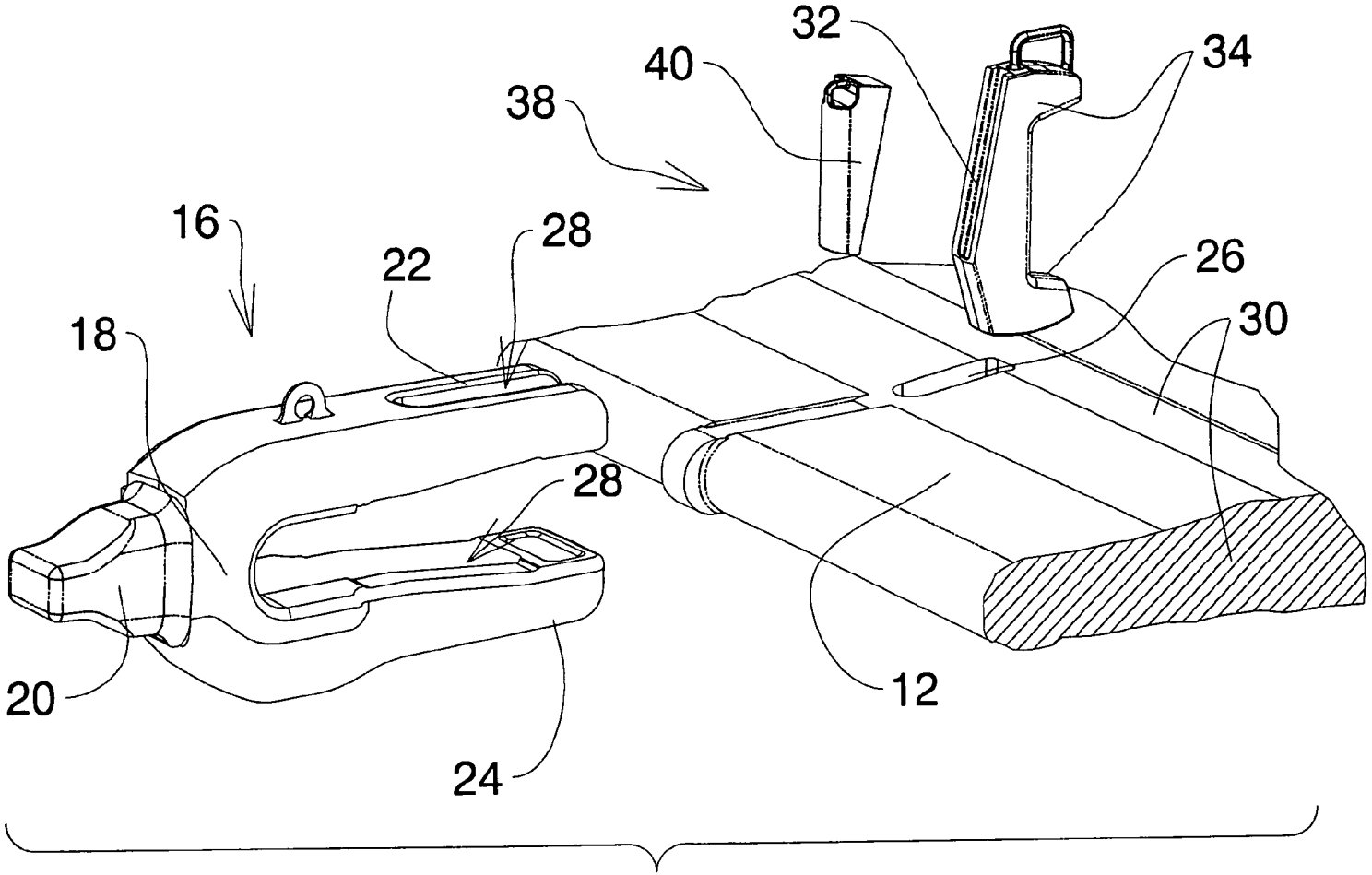
FIG. 2 is an isometric exploded view of a tooth retention device.
Figure 3:
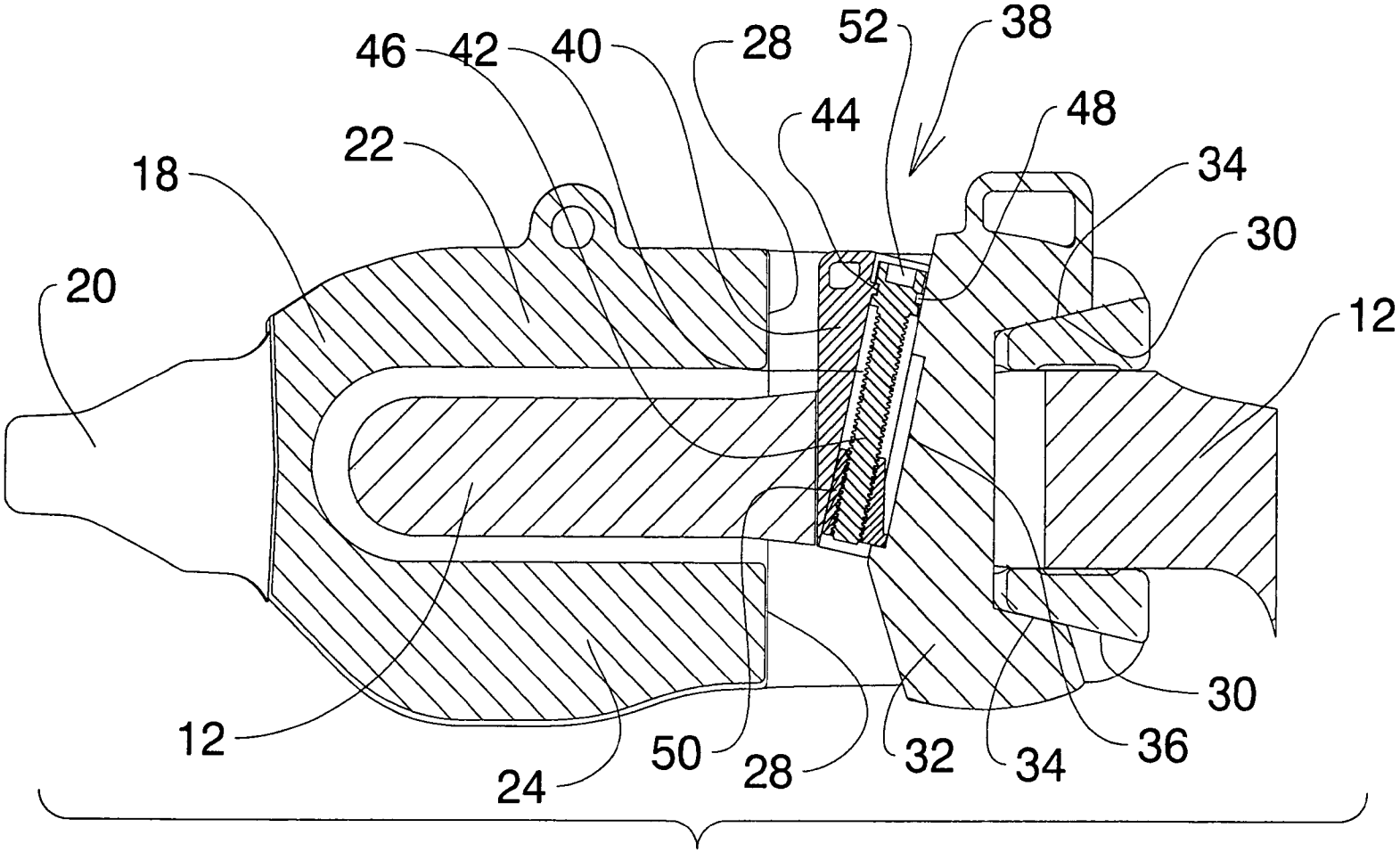
FIG. 3 is a section showing the wedge block in a first position.

A first embodiment of the tooth retention device is shown in more detail in FIGS. 2 and 3; The tooth retention device (16) of this embodiment comprises a main body (18) having a forwardly extending tooth support (20) formed integrally. This support fits into the tooth (14) in known manner, and the tooth is secured in known manner.

Extending rearwardly from body (18) there are upper and lower arms (22) and (24), forming a fork. The arms embrace the lip (12) of the bucket (10).

The lip (12) is formed with clamp openings (26) with angled diverging forward and rearward pressure surfaces.

The arms (22) and (24) are formed with respective clamp slots (28). C-shaped clamps (32) are shaped and adapted to fit through clamp slots (28) and through clamp openings (26) in the lip. The upper and lower edges (34) of the C clamp are formed at angles as to make a tapered wedging fit against angled surfaces (30) of lip (12).

In order to hold the C clamp (32) in position, the C clamp (32) is formed with a rectangular block space (36).

Each retention device is provided with a releasable wedge member (38).

Wedge member (38) consists of an integral wedge body (40) tapering from a wide upper end to a narrower lower end. It has a generally U-shaped channel (42), with a semi-annular ridge (44) at its upper end.

Within channel (42) there is a threaded rod (46), with an annular groove (48) for receiving the ridge (44).

A wedge block nut (50) with an internal thread fits on rod (46). A portion of block nut (50) extends out from channel (42). Rotation of rod (46) will drive the block nut (50) up or down channel (42).

The engagement of the groove (48) on the ridge (44) retains the rod (46) in a predetermined location, while allowing it to rotate for purposes described below.

In operation the arms (22) and (24) are slid around the lip (12) of the bucket, with the clamp opening (26) registering with the clamp slots (28).

A C clamp (32) is then slid through the clamp slots (28) and clamp opening (26), with its upper and lower angled surfaces (34) fitting over the angled surfaces (30).

A wedge member (38) is then slid down into the clamp slots (28) and clamp opening (26).

At this stage the wedge block nut (50) is threaded down to it lowest position on rod (46) A suitable tool (alien key or the like) engages head (52) and is then used to rotate rod (46).

This will cause the block nut (50) to move upwardly within channel (42).

The block nut (50) will then contact the C clamp (32) within rectangular space (36). Tightening of rod (46) will cause block nut (50) to clamp between the C clamp (32), and the lip (12) and hold the C clamp (32) firmly in position.

Removal of the retention device (16) proceeds in the opposite manner by reversing rod (46) and thus releasing the block nut (50) from the C clamp (32).

Figure 4:
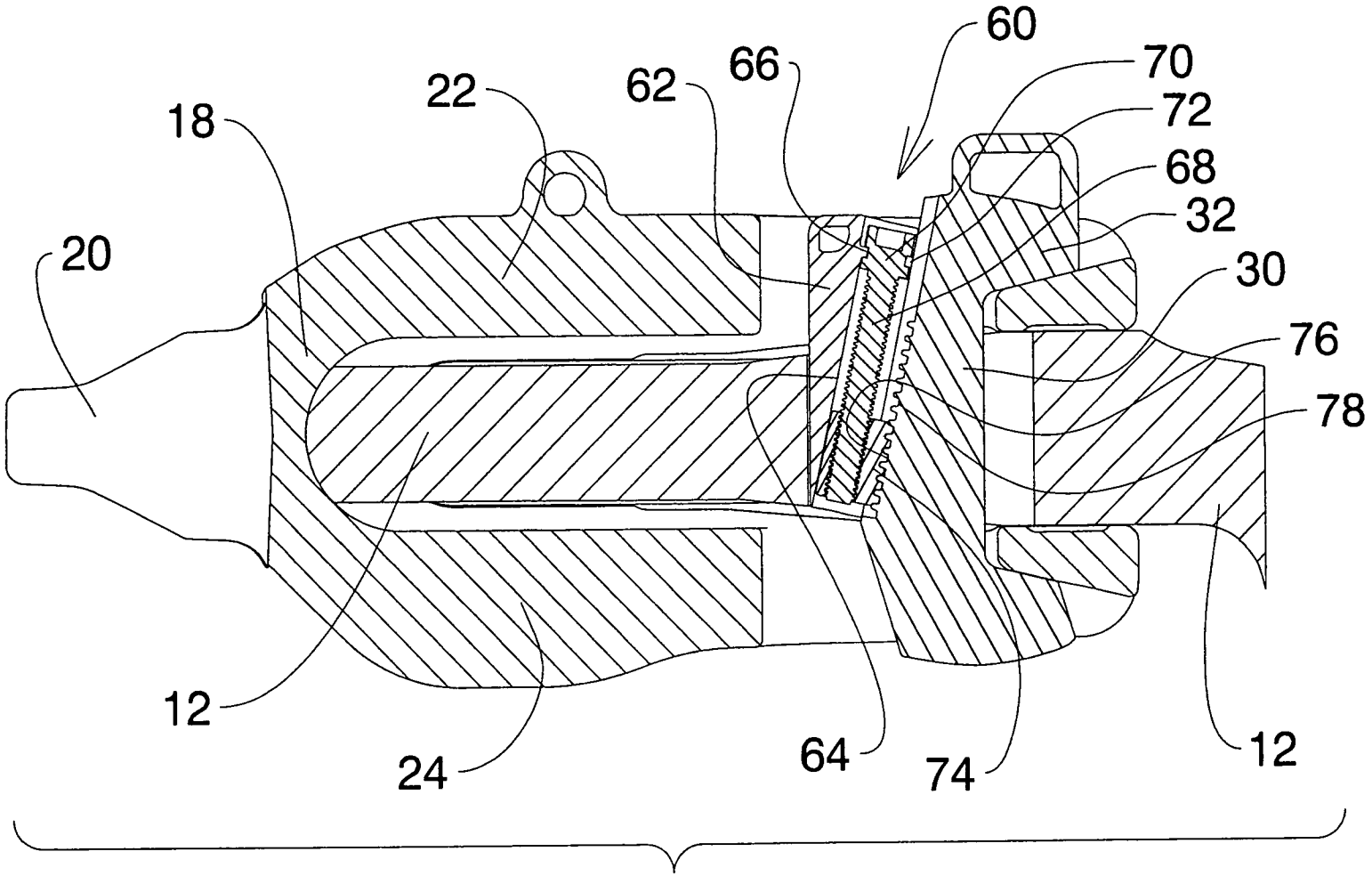
FIG. 4 is a section showing a further embodiment of the wedge block in a second position.
Figure 5:
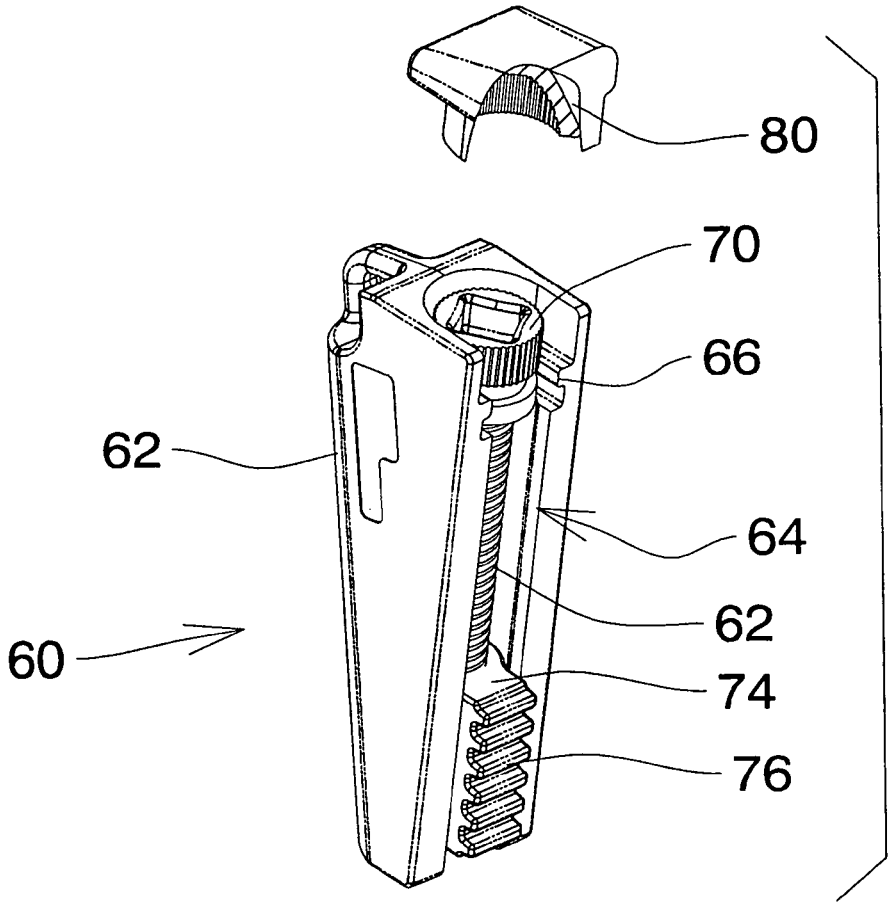
FIG. 5 is an isometric of the wedge and wedge block and cap.
Figure 6:
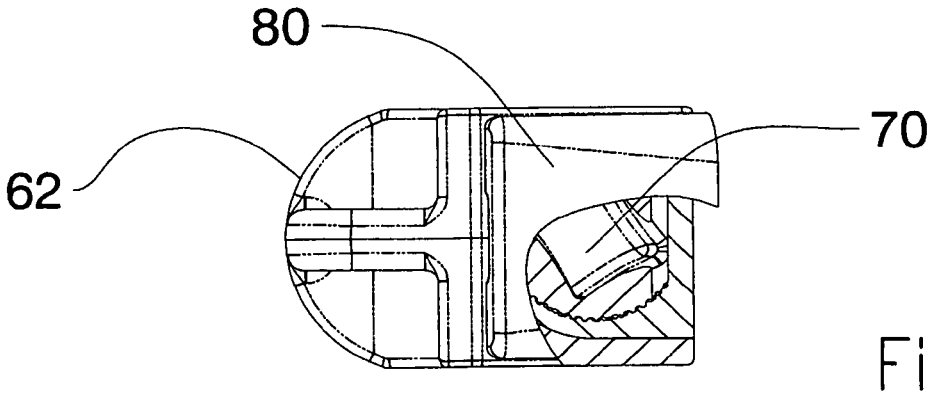
FIG. 6 is a partly cut away view top plan of the plastic cap.

A further embodiment of the invention is illustrated in FIGS. 4, 5 & 6.

In these illustrations, the basic components, namely the tooth retention device (16), and the C clamp (32), are retained. However in this embodiment the wedge member is illustrated as (60). The wedge member (60) has a wedge body (62) tapering from a wide upper end to a narrower lower end. The wedge body (62) has a generally u-shaped channel (64).

At the upper end of the channel (64), there is a semi-annular ridge (66) forming a collar. Within the channel (66), there is a threaded rod (68). The rod (68) has a head portion (70) with an annular groove (72) formed around it, to receive the ridge (66). A block nut (74) is threadedly received on the threaded rod (68). The block nut (74) has a ridged rack portion (76) extending therefrom normal to the axis of the nut (74)

The C clamp (32) in this embodiment is somewhat modified. It has a clamp rack portion (78) formed thereon, extending upwardly and downwardly, and receiving rack (76) of the block nut (74).

In operation, in this embodiment, the threaded rod is first of all rotated so as to drive the block nut down to the lower most point on the rod. The wedge member is then inserted, in the same way as before in the previous embodiment, seating against the lip of the shovel. The threaded rack portion (76) on the block nut (74), will engage the lower most ridges of the clamp rack portion (78) on the C clamp (32). The rod (68) is then rotated, by a suitable tool such as an alien key (not shown). This will cause the block nut (74) to progress up the threaded rod (68). However since the block nut rack portion (76) is engaging the rack portion (78) of the C-clamp (32), the block nut (74) cannot move upwardly. Consequently, such rotation of the rod will drive the entire wedge member (60) downwardly, thereby forcing it against one surface of the lip (12), and at the same time urging the C clamp (32) rearwardly against the other surface of the lip. In this way the retention device is held securely in position.

For the sake of security, a cap (80) typically formed of resilient synthetic plastic material or the like, will be press fitted onto the top of the nut (74), thereby preventing it from rotating. At the same time it will prevent the entry of foreign matter, which might damage the key surfaces on the nut head, and make it difficult to remove. Such a cap is also used in the embodiment of FIGS. 2 and 3.

The cap (80) has internal ridges formed to inter-engage with grooves on the head of the rod. This will resist any tendency for the threaded rod not to be loosened during use. The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A tooth retention device for attachment to an edge of excavator bucket, said bucket defining a bucket opening, and comprising:

a tooth mounting portion;

a fork-shaped body forming part of said tooth mounting portion fitting over said edge of said bucket, said fork-shaped body defining a fork opening registering with said bucket opening;

a generally C-shaped clamp passing through said bucket opening and said fork opening in said fork-shaped body;

a wedge located alongside said clamp and extending into said fork opening and said bucket opening and holding the clamp in position;

a generally U-shaped axial recess extending longitudinally along said wedge;

a threaded rod and a threaded wedge block on the rod, received in said axial recess in said wedge and wherein the rod is rotatable to move the wedge block along the rod within said axial recess between locked and released positions;

a wedge block engagement portion on said wedge block, and, a clamp engagement portion on said clamp, said wedge block engagement portion and said clamp engagement portion being inter-engageable with one another upon insertion of said wedge into said bucket opening and said fork opening.

2. A tooth retention device as claimed in claim 1 wherein said wedge has a generally tapering shape from a narrower end to a wider end.

3. A tooth retention device as claimed in claim 2 wherein said clamp has a wedge receiving recess, and wherein said wedge block is moveable along said recess between said locked and released positions.

4. A tooth retention device as claimed in claim 3 wherein said axial recess comprises a channel formed in said wedge, and said threaded rod being received in said channel, and a semi-annular ridge formed on said channel and an annular groove formed in said rod for receiving said ridge.

5. A tooth retention device as claimed in claim 4 wherein said threaded rod is formed with a head at one end, and including a resilient cap adapted to make a friction fit over said head, thereby retaining the same against inadvertent rotation.

6. A tooth retention device as claimed in claim 5 and including a generally annular collar recess formed in said rod, and a semi-circular collar ring formed on said channel, and received in said annular collar recess.

7. A tooth retention device as claimed in claim 6 wherein said fork-shaped body is formed with upper and lower diverging clamping surfaces, and wherein said clamp is formed with upper and lower clamping surfaces, diverging from one another, and adapted to inter-fit with said clamping surfaces of said fork-shaped body.

8. A tooth retention device as claimed in claim 7 including an excavator bucket, a lip portion on said bucket, fitting into said fork-shaped body, and said bucket opening being formed through said lip portion, and a wedging surface defined by one side edge of said lip portion, said wedge being adapted to engage said wedging surface, on one side of said wedge and said wedge being adapted to engage said clamp on the opposite side of said wedge, thereby urging said clamp away from said wedging surface of said lip portion.

9. A tooth retention device as claimed in claim 8 wherein said wedge block engagement portion comprises a plurality of wedge teeth, and wherein said clamp engagement portion comprises a plurality of clamp teeth, said wedge teeth and said clamp teeth being inter-engageable with each other.

* * * * *